US005839979A

United States Patent [19]

De Genty

[11] Patent Number: 5,839,979

[45] Date of Patent: Nov. 24, 1998

[54] BAT FOR BALL GAME

[76] Inventor: Nicolas De Genty, 9 rue des Roses, 25460 Etupes, France

[21] Appl. No.: 240,723

[22] PCT Filed: Sep. 13, 1993

[86] PCT No.: PCT/FR93/00874

§ 371 Date: May 11, 1994

§ 102(e) Date: May 11, 1994

[87] PCT Pub. No.: WO94/07571

PCT Pub. Date: Apr. 14, 1994

[30] Foreign Application Priority Data

Oct. 2, 1992 [FR] France ..... 92 12111

[51] Int. Cl.[6] ..... A63B 49/00

[52] U.S. Cl. ..... 473/464; 473/463; 473/518; 473/524; 473/527

[58] Field of Search ..... 273/67 R, 67 B, 273/73 R, 73 C; 473/464, 463, 518, 524, 527

[56] References Cited

U.S. PATENT DOCUMENTS 5,027,439 7/1991 Spector ..... 273/67 B
5,150,896 9/1992 Holmes ..... 273/67 R
5,236,191 8/1993 Capriati ..... 273/67 B

FOREIGN PATENT DOCUMENTS 444407 5/1927 Germany ..... 273/67 B
7605224 9/1977 Netherlands ..... 273/67 B

*Primary Examiner*—John G. Weiss
*Assistant Examiner*—William J. Deane, Jr.
*Attorney, Agent, or Firm*—Davis and Bujold

[57] ABSTRACT

A bat in the form of a sleeve can be slid over the hand of a player so that the latter can play as in tennis, on any type of ground, with or without a bounce on the ground. The bat (1) comprises an upper sleeve element (5) and a lower sleeve element (6) joined along an edge (7) wherein an opening (10) is provided for inserting the hand. Each sleeve element is more rigid in a flat central portion (11, 12) forming a striking surface than close to its periphery. The bat envelops and holds the hand due to its inherent elasticity. It may also comprise retaining means (13) on the surface and closure devices to each side of the wrist.

11 Claims, 2 Drawing Sheets

BAT FOR BALL GAME

Figure 1:
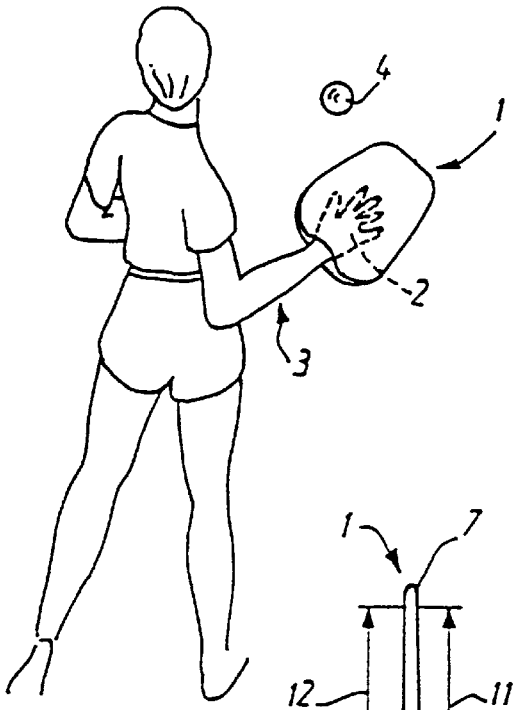

This application is a 371 of PCT/FR93/00874 filed Sep. 13, 1993.

The present invention relates to a bat for ball game, comprising two striking surfaces on opposite sides and provided in a sleeve to receive a player's open hand.

Such a bat is in particular designed to make it possible to play a ball game with or without the ball bouncing on the ground, similar to the way tennis is played, but on any surface whatsoever, generally smaller than tennis courts or in places where the ball can not bounce. With this aim in mind, there are already numerous types of bats forming rackets without a shaft or with a shortened shaft which, on one or both sides of the hand, have a striking plate provided with a handle or a fastener connecting it to the player's hand. These devices have not been a commercial success, which can be attributed to shortcomings in terms of their efficiency, comfort and ability to adjust to the player's hand.

An example of prior art, described in patent application FR-A-2 437 848, is a bat comprising a sleeve in the external shape of an open hand, with two striking plates on its opposite sides, which converge slightly in the direction of the end of the fingers. It is difficult for the hand, inserted in the gap in the shape of a dihedron between the two flat plates, to be both comfortable and held properly. The document describes another embodiment where the sleeve is an actual glove with each side having several striking plates spread out facing the fingers, palm and back of the hand. The result is a discontinuous striking surface, the shape of which can vary considerably with the movements of the hand which does not therefore make it possible to direct the ball accurately.

The present invention aims to create a bat which to a great extent avoids the drawbacks mentioned above and which holds the hand and keeps it in position, relieving it of any gripping effort.

With this aim in mind, the invention relates to a bat of the type mentioned above, characterised in that the sleeve is formed by two generally flat shaped elements, which are joined to one another along their periphery with the exception of the opening for inserting the hand, and in that each element of the sleeve is more rigid in a flat central portion, where it forms a virtually flat striking surface, than close to its periphery.

In that way, the elasticity of the peripheral parts of the bat allow the latter to envelop the player's hand providing both enough comfort and sensitivity for striking the ball. At the same time, the rigidity of the central portion serving as a striking surface makes it possible to direct the ball accurately.

In a preferred form of embodiment of the bat according to the invention, at least one of the sleeve elements comprises airholes in the area of its striking surface. The airholes are preferably defined by a grid of rigid ribs covering at least a part of the striking surface. The said grid can have an irregular layout forming a decorative figure.

The bat is preferably made of an elastic material which allows it to fit the shape of the hand. At least the sleeve element situated on the palm side of the hand may have retaining means on the surface on the inside to keep it in position on the hand, with the said retaining means comprising at least one hollow to hold the palm on the side of the said opening. The said retaining means can also have protuberances between the fingers of the hand.

In a special form of embodiment, at least one of the two sleeve elements can have two folds located on both sides of the position of the hand and converging in the direction of the said opening, along with closure devices provided outside the folds and provided to join both the elements together in such a way that they can be released on both sides of a user's wrist.

Preferably, along the said opening, each sleeve element comprises a free edge with a rounded, convex profile on the hand side. Each sleeve element or both the elements can be a moulded piece in synthetic material.

Figure 2:
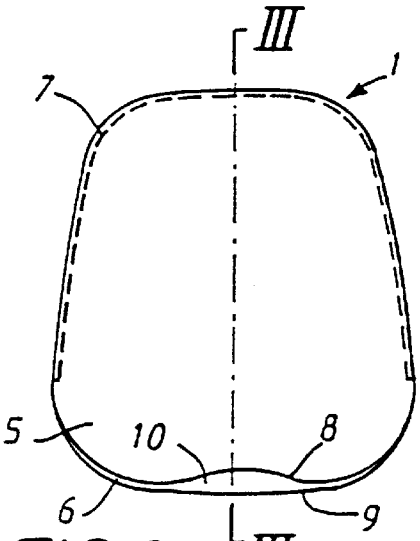
Figure 3:
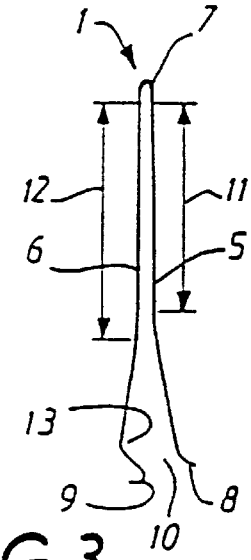
Figure 4A:
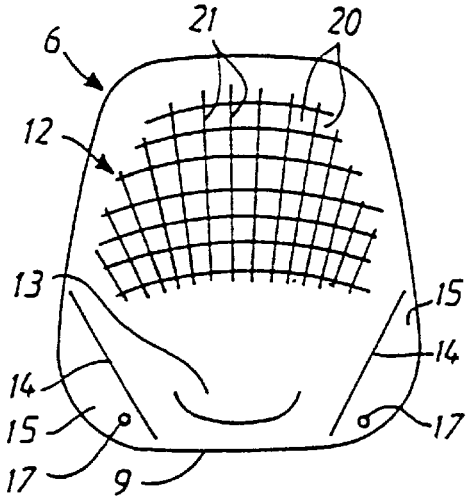
Figure 4B:
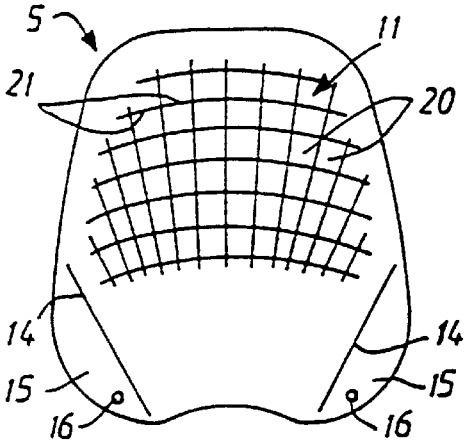
Figure 5:
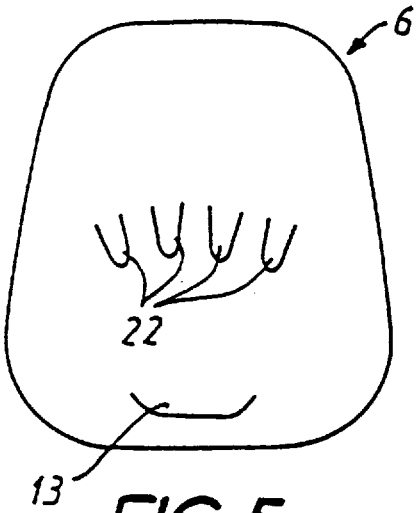
Figure 6:
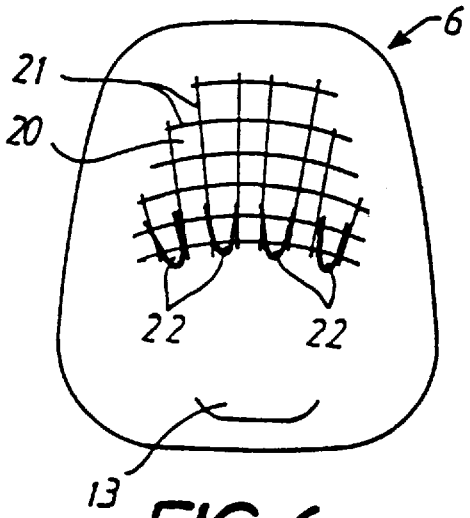
Figure 7:
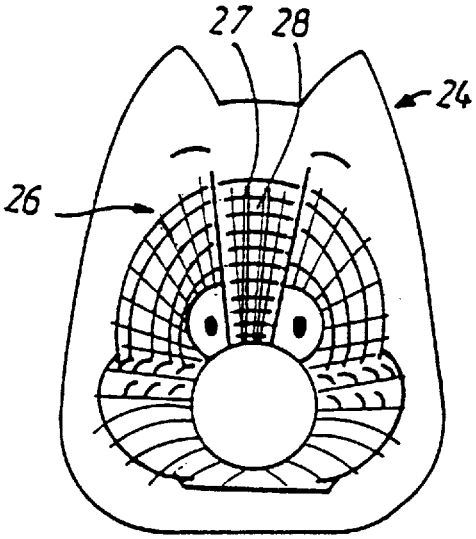
Figure 8:
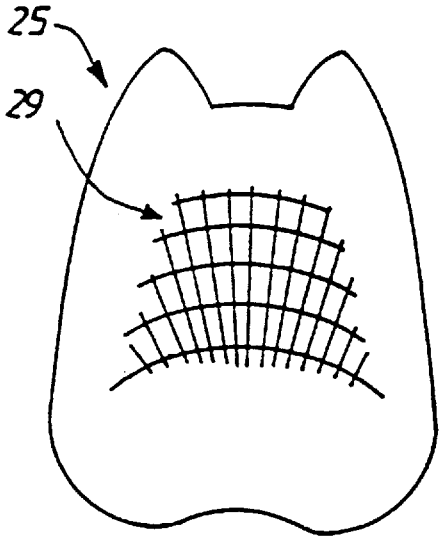

Other features and advantages of the present invention will be highlighted in the following description of various forms of embodiment, with reference to the attached drawings, in which:

FIG. 1 is a schematic elevation illustrating a bat according to the invention and how it is used by a player, FIG. 2 is a schematic view from above of the bat, FIG. 3 is a schematic cutaway view along the III—III line in FIG. 2, FIGS. 4*a* and 4*b* show the insides of the bat's two sleeve elements, in a special form of embodiment, FIG. 5 is a view of the inside of the sleeve element seen facing the palm and provided with retaining means, FIG. 6 is a similar view of FIG. 5, illustrating another form of embodiment, and FIGS. 7 and 8 represent the two respective sides of a bat according to the invention, in another form of embodiment.

FIG. 1 is a schematic representation of a bat 1 in the form of a sleeve, inserted over the hand 2 of a player 3 who uses the bat 1 like a racket to strike a ball 4. The player 3 can wear the bat 1 on his left or right hand, as he likes, or possibly one bat on each hand. As shall be seen later, the bat 1 is used to strike the ball 4 with a forehand or backhand drive.

The bat 1 is in a general shape illustrated by FIGS. 2 and 3 and comprises an upper element 5, which goes on the back of the hand, and a lower element 6 which goes on the palm side of the hand. The two elements 5 and 6 are firmly attached or joined to one another on most of their periphery, e.g. sown or glued together, which forms a closed edge 7 shown by an unbroken line in FIG. 2. On the rest of their periphery, the elements 5 and 6 have free edges 8 and 9 respectively between which is provided an opening 10 to insert the hand in. In its central area, the upper element 5 comprises a relatively rigid flat part 11, serving as a striking surface to strike the ball with a backhand drive. The lower element 6 is also provided with a relatively rigid flat part 12 serving as a striking surface to strike the ball with a forehand drive. When the player's hand is inserted in the sleeve, the elements 5 and 6 part elastically by bending in the vicinity of their common edge 7, with the result that the bat 1 can hold simply by grasping the hand it contains. In FIG. 2, it can be noticed that the shape of the bat is symmetrical on a plane, in such a way that it adapts equally well to both the left hand and the right hand. In FIG. 3, it can be seen that the lower element 6 presents a hollow 13 between its flat part 12 and its free edge 9, to contribute to holding the bat on the hand by engaging the prominent base of the palm in this hollow. The two free edges 8 and 9 have an outwardly curved profile to avoid hurting the player's skin.

Preferably, the closure devices are provided in the opening 10, on either side of the player's wrist, so that the bat is held better on the hand. These can be press studs, "Velcro" self-gripping strips, fastenings devices with eyelets or any other equivalent means. An example of a closure device is illustrated in FIGS. 4*a* and 4*b*, which shows the inner surfaces of the two sleeve elements 5 and 6. Each element 5, 6 is provided with two folds 14 which both converge in the direction of the wrists and each mark an angle zone 15 where a press stud 16, 17 is provided, used along with an additional button 17, 16 provided on the other element. The folds 14 make it possible to easily close the angle zones 15 without excessive bending of the other parts of the element, particularly on its shaped edge 8, 9. The hollow 13 to hold the hand in position is between the two folds 14 of the lower element 6.

Otherwise, FIGS. 4*a* and 4*b* show that the flat parts 11, 12 of the two elements 5, 6 are hemstitched in the shape of a grid comprising airholes 20 between rigid ribs 21. Good ventilation inside the bat is an important comfort factor, in order to avoid the effects of perspiration. What is more, the ribs 21 make up a rough striking surface which makes it possible to spin the ball. They can have any appropriate cross section whatsoever and in particular be wider on the hand side to reduce the contact pressure.

FIG. 5 shows a case where the retaining means on the surface provided on the inside of the lower element 6 present, in addition to the hollow 13 to hold the palm, undulations forming four long protuberances 22 between which the three middle fingers of the hand are placed. The symmetrical arrangement of these undulations is suitable for both the left and right hand. In the example in FIG. 6, similar protuberances 22 are provided in an element 6 provided with a ventilation grid made up of holes 20 and ribs 21 as in the case of FIGS. 4*a* and 4*b*. Making these reliefs poses no problem if the sleeve elements or the entire bat are moulded parts in synthetic material.

In another embodiment, each sleeve element can be made of two distinct layers glued one on top of the other, i.e. a relatively rigid outer layer and an internal padding layer with superficial reliefs which fit those of the hand.

FIGS. 7 and 8 illustrate a form of embodiment of a bat according to the invention which presents an original and amusing appearance, evoking a cat's head. FIG. 7 shows the outside of the lower element 24 of the bat, i.e. on the palm side of the hand, and FIG. 8 shows the upper element 25. Both elements have similar outlines, but on element 24, the striking surface 26 is formed by a grid of ribs 27 and airholes 28 the shape of which represents a cat's face. This pattern can of course be added to with colour printing. On the back of the bat, the striking surface 29 of the upper element 25 can be of any shape whatsoever, similar to the one shown in FIGS. 4*a* and 4*b*.

This invention is not restricted to the examples of embodiments described above, but can be widened to include any modification or variation which is obvious for the expert.

I claim:

1. A bat, for playing a ball game, comprising:

a unitary single piece elastic sleeve being closed at one end thereof and open at the other end, for insertion of a player's hand therein, and having front and back sides for respectively overlying a front and back of a player's hand when inserted in said sleeve;

said front and back sides of said sleeve both having a substantially planar central portion, defining a striking surface, and a peripheral portion integrally formed with said central portion, the peripheral portion of each side being connected to the peripheral portion of the other side along the entire periphery thereof except for at the open end of said sleeve;

said central portions being more rigid than said peripheral portions, so that when a player's hand is inserted in said sleeve, said peripheral portions are resiliently stretched, and said sleeve grips such a player's hand for retaining such a player's hand in said sleeve, and said central portions remain substantially planar;

wherein a depression in an inner surface of said front side of said sleeve, said depression being sized and shaped to at least partially receive a player's palm therein to facilitate retention of a slaver's hand in said sleeve;

a free edge of the open end of said sleeve having an inwardly facing, relative to the sleeve, rounded, convex profile that, when a player's hand is inserted in said sleeve, faces the player's hand; and at least one of the sides of said sleeve has inwardly extending U-shaped folds formed therein, said folds are spaced inwardly from the periphery of said sleeve and are adjacent to and on either side of said open end of said sleeve, said folds converge as they approach said open end and releasable closure means are located adjacent to and outside of each fold, relative to said open end, to, when a player's hand is inserted in said sleeve, close said open end on the player's wrist and retain said sleeve on the player's hand.

2. A bat as in claim 1, wherein at least one protuberance, projects from an inner surface of said front side of said sleeve and substantially extends in a longitudinal direction of the sleeve, said at least one protuberance is sized, shaped and arranged to fit between fingers of a player's hand when inserted into said sleeve and the front and back sides of said sleeve are each individually symmetrical about a longitudinal axis thereof and said sleeve fits both a player's right hand and left hand.

3. A bat as in claim 2, comprising four of said protuberances defining three spaces therebetween for receiving the middle three fingers of a player's hand when inserted into said sleeve.

4. A bat as in claim 1, comprising air holes in at least one of said striking surfaces for ventilating an interior of said sleeve.

5. A bat as in claim 4, wherein said air holes are defined by a grid of ribs that define at least a portion of said striking surface(s).

6. A bat, for playing a ball game, comprising:

a unitary single piece elastic sleeve being closed at one end thereof and open at the other end, for insertion of a player's hand therein, and having front and back sides for respectively overlying a front and back of a player's hand when inserted in said sleeve;

said front and back sides of said sleeve both having a substantially planar central portion, defining a striking surface, and a peripheral portion integrally formed with said central portion, the peripheral portion of each side being connected to the peripheral portion of the other side along the entire periphery thereof except for at the open end of said sleeve;

said central portions being more rigid than said peripheral portions, so that when a player's hand is inserted in said sleeve, said peripheral portions are resiliently stretched, and said sleeve grips such a player's hand for retaining such a player's hand in said sleeve, and said central portions remain substantially planar; and wherein at least one protuberance, projects from an inner surface of said front side of said sleeve, said at least one protuberance substantially extends in a longitudinal direction of the sleeve and is sized, shaped and arranged to fit between fingers of both a player's left and right hand, respectively, when inserted into said sleeve; and at least one of the sides of said sleeve has inwardly extending U-shaped folds formed therein, said folds are spaced inwardly from the periphery of said sleeve and are adjacent to and on either side of said open end of said sleeve, said folds converge as they approach said open end and releasable closure means are located adjacent to and outside of each fold, relative to said open end, to, when a player's hand is inserted in said sleeve, close said open end on the player's wrist and retain said sleeve on the player's hand.

7. A bat, for playing a ball game, comprising:

a unitary, single piece elastic sleeve closed at one end thereof and open at the other end, for insertion of a player's hand therein, and having front and back sides for respectively overlying a front and back of a player's hand when inserted in said sleeve;

said front and back sides of said sleeve both having a substantially planar central portion, defining a striking surface, and a peripheral portion integrally formed with said central portion, the peripheral portion of each side being connected to the peripheral portion of the other side along the entire periphery thereof except for at the open end of said sleeve;

said central portions being more rigid than said peripheral portions, so that when a player's hand is inserted in said sleeve, said peripheral portions are resiliently stretched, and said sleeve grips such a player's hand for retaining such a player's hand in said sleeve, and said central portions remain substantially planar; and wherein at least one of the sides of said sleeve has inwardly extending, relative to said sleeve, U-shaped folds formed therein, said folds are spaced from the periphery of said sleeve and are adjacent to and on either side of said open end of said sleeve, said folds converge as they approach said open end and releasable closure means are located outside of each fold, relative to said open end, to, when a player's hand is inserted in said sleeve, close said open end on the player's wrist and retain said sleeve on the player's hand.

8. A bat as in claim 7, comprising four protuberances, projecting from an inner surface of said front side of said sleeve, that extend generally in a longitudinal direction of the sleeve and are sized, shaped and arranged to fit between the middle three fingers of a player's hand when inserted into said sleeve; and wherein the front and back sides of said sleeve are each symmetrical about a longitudinal axis thereof and said sleeve fits both a player's right hand and left hand.

9. A bat as in claim 7, comprising air holes in at least one of said striking surfaces for ventilating an interior of said sleeve.

10. A bat as in claim 9, wherein said air holes are defined by a grid of ribs that define at least a part of said striking surface(s).

11. A bat as in claim 7, comprising a depression in an inner surface of said front side of said sleeve, said depression being sized and shaped to at least partially receive a player's palm therein to facilitate retention of a player's hand in said sleeve.

* * * * *